US006675891B2

(12) United States Patent
Hailey, Jr. et al.

(10) Patent No.: US 6,675,891 B2
(45) Date of Patent: Jan. 13, 2004

(54) APPARATUS AND METHOD FOR GRAVEL PACKING A HORIZONTAL OPEN HOLE PRODUCTION INTERVAL

(75) Inventors: Travis T. Hailey, Jr., Sugar Land, TX (US); Colby Munro Ross, Carrollton, TX (US); Robert Lester Thurman, Carrollton, TX (US); Robert Craig Hammett, Garland, TX (US); David Leslie Lord, Marlow, OK (US); Imre I. Gazda, Fort Worth, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 50 days.

(21) Appl. No.: 10/026,502

(22) Filed: Dec. 19, 2001

(65) Prior Publication Data

US 2003/0111224 A1 Jun. 19, 2003

(51) Int. Cl.[7] ..... E21B 43/08
(52) U.S. Cl. ..... 166/228; 166/51; 166/321
(58) Field of Search ..... 166/278, 51, 321, 166/334.1

(56) References Cited

U.S. PATENT DOCUMENTS

| | | | | |
|---|---|---|---|---|
| 4,062,403 | A | 12/1977 | Sparlin | 166/156 |
| 4,162,691 | A | 7/1979 | Perkins | 137/613 |
| 4,428,428 | A | 1/1984 | Smyrl et al. | 166/278 |
| 4,522,264 | A | 6/1985 | McNeer | 166/278 |
| 6,311,772 | B1 * | 11/2001 | Myhre et al. | 166/278 |
| 2002/0096329 | A1 | 7/2002 | Coon et al. | 166/278 |
| 2002/0157837 | A1 * | 10/2002 | Bode et al. | 166/373 |

FOREIGN PATENT DOCUMENTS

| | | | |
|---|---|---|---|
| GB | 2353311 A | 2/2001 | E21B/43/04 |
| GB | 2353312 A | 2/2001 | E21B/43/04 |

OTHER PUBLICATIONS

Beta–Breaker System.*

"Beta–wave Pressure Control Enables Extended–Reach Horizontal Gravel Packs," Martin P. Coronado, SPE, and T. Gary Corbett, SPE, both of Baker Oil Tools. Society of Petroleum Engineers Inc., 2001.

"Using Beta–Wave Pressure Control to Achieve Isolation in Horizontal Gravel Packs: A Deepwater Brazil Case History," Gene Ratterman, Leo Hill, and Jeff Knippa, all three of Baker Oil Tools; Antonio Machado, and Agostinho Calderon, both of Petrobras. 2001.

* cited by examiner

*Primary Examiner*—William Neuder
(74) *Attorney, Agent, or Firm*—Lawrence R. Youst

(57) ABSTRACT

An apparatus for gravel packing a production interval (42) of a wellbore (32) comprises first and second sand control screen assemblies (56, 58) connected downhole of a packer assembly (46) and a cross-over assembly (40) that provides a communication path (74) downhole of the packer assembly (46) for a gravel packing fluid and a communication path (92) uphole of the packer assembly (46) for return fluids. A wash pipe assembly (66) extends into the first and second sand control screen assemblies (56, 58) forming an annulus (84) therebetween. A valve (70) is positioned within the wash pipe assembly (66) in a location between the first and second sand control screen assemblies (56, 58). The valve (70) is actuatable from a closed position to an open position when the beta wave (100) is proximate the location of the valve (70).

45 Claims, 10 Drawing Sheets

APPARATUS AND METHOD FOR GRAVEL PACKING A HORIZONTAL OPEN HOLE PRODUCTION INTERVAL

TECHNICAL FIELD OF THE INVENTION

This invention relates in general to preventing the production of particulate materials through a wellbore traversing an unconsolidated or loosely consolidated subterranean formation and, in particular to, an apparatus and method for obtaining a substantially complete gravel pack within a horizontal open hole production interval without fracturing the formation.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

Typically, the liquid carrier is returned to the surface by flowing through the sand control screen and up a wash pipe. The gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long production intervals that are inclined, deviated or horizontal. Using conventional gravel packing techniques, the pressure required to pump the fluid slurry to the entire production interval may exceed the fracture pressure of the formation which results in the liquid carrier of the fluid slurry leaking off into the formation.

One technique used to reduce the required pressure for gravel packing a long production interval that is inclined, deviated or horizontal is the alpha-beta gravel packing method. In this method, the gravel packing operation starts with the alpha wave depositing gravel on the low side of the wellbore progressing from the near end to the far end of the production interval. Once the alpha wave has reached the far end, the beta wave phase begins wherein gravel is deposited in the high side of the wellbore, on top of the alpha wave deposition, progressing from the far end to the near end of the production interval.

It has been found, however, that in certain formations with low fracture pressures, such as those found in deep water operations, the pressure required to propagate the beta wave may exceed the fracture pressure of the formation. Therefore a need has arisen for an improved apparatus and method for gravel packing a long production interval that is inclined, deviated or horizontal. A need has also arisen for such an improved apparatus and method that achieve a complete gravel pack of such production intervals and that do not require the pumping of the fluid slurry at a pressure above the fracture pressure of the formation.

SUMMARY OF THE INVENTION

The present invention disclosed herein comprises an apparatus and method for gravel packing a long production interval that is inclined, deviated or horizontal. The apparatus and method can achieve a complete gravel pack of such a production interval without pumping of the fluid slurry at a pressure above the fracture pressure of the formation The apparatus comprises first and second sand control screen assemblies that are connected downhole of a packer assembly. A cross-over assembly that traverses the packer provides a lateral communication path downhole of the packer assembly for the delivery of a gravel packing fluid and a lateral communication path uphole of the packer assembly for the flow of return fluids. A wash pipe assembly, which is in communication with the lateral communication path uphole of the packer assembly, extends into the first and second sand control screen assemblies such that an annulus is formed therebetween. The wash pipe assembly includes a valve that is positioned in a hole location between the first and second sand control screen assemblies. The valve is actuatable from a closed position to an open position when the beta wave of the alpha-beta gravel packing operation is proximate the valve location such that the pressure required to complete the gravel pack will not exceed the fracture pressure of the formation.

The valve may be actuated in response to a differential pressure in the annulus upstream and downstream of the valve. Alternatively, the valve may be actuated in response to either an increase in the density in the wellbore caused by the beta wave gravel deposition or in response to an increase in flow velocity past the valve caused by the beta wave gravel deposition. In the embodiment wherein the valve is actuated by differential pressure, the valve may include an outer housing having an upstream pressure port in fluid communication with the annulus upstream of the valve and a downstream pressure port in fluid communication with the annulus downstream of the valve.

Also in the embodiment wherein the valve is actuated by the differential pressure, the differential pressure may be intensified by placing a restrictor member between the first and second sand control screen assemblies or within the wash pipe assembly or both. The restrictor members are used to reduce the flow area in the annulus adjacent to the restrictor members, thereby increasing the pressure drop in the return fluid traveling therethrough. A restrictor member placed between the first and second sand control screen assemblies may be positioned in the hole location adjacent to the valve. Likewise, a restrictor members placed within the wash pipe assembly may be integral with the valve.

To further intensify the differential pressure, the restrictor members may include turbulizing profiles that create turbulence in the flow of the return fluid in the annulus adjacent to the restrictor members, thereby increasing the pressure drop in the return fluid traveling therethrough. Alternatively, turbulizer members may replace the restrictor members and may be disposed between the first and second sand control screen assemblies or within the wash pipe assembly or both to create turbulence in the flow of the return fluid in the annulus adjacent to the turbulizer members.

The method of the present invention involves positioning first and second sand control screen assemblies within the production interval, disposing a wash pipe assembly within the first and second sand control screen assemblies such that an annulus is formed therebetween, injecting a fluid slurry containing gravel into the production interval exteriorly of the first and second sand control screen assemblies, depositing gravel on a low side of the production interval by propagating an alpha wave from the near end to the far end of the production interval, depositing gravel on a high side of the production interval on top of the gravel on the low side of the production interval by propagating a beta wave from the far end to the near end of the production interval and actuating a valve disposed in the wash pipe between the first and second sand control screen assemblies from a closed position to an open position when the beta wave is proximate the location of the valve.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
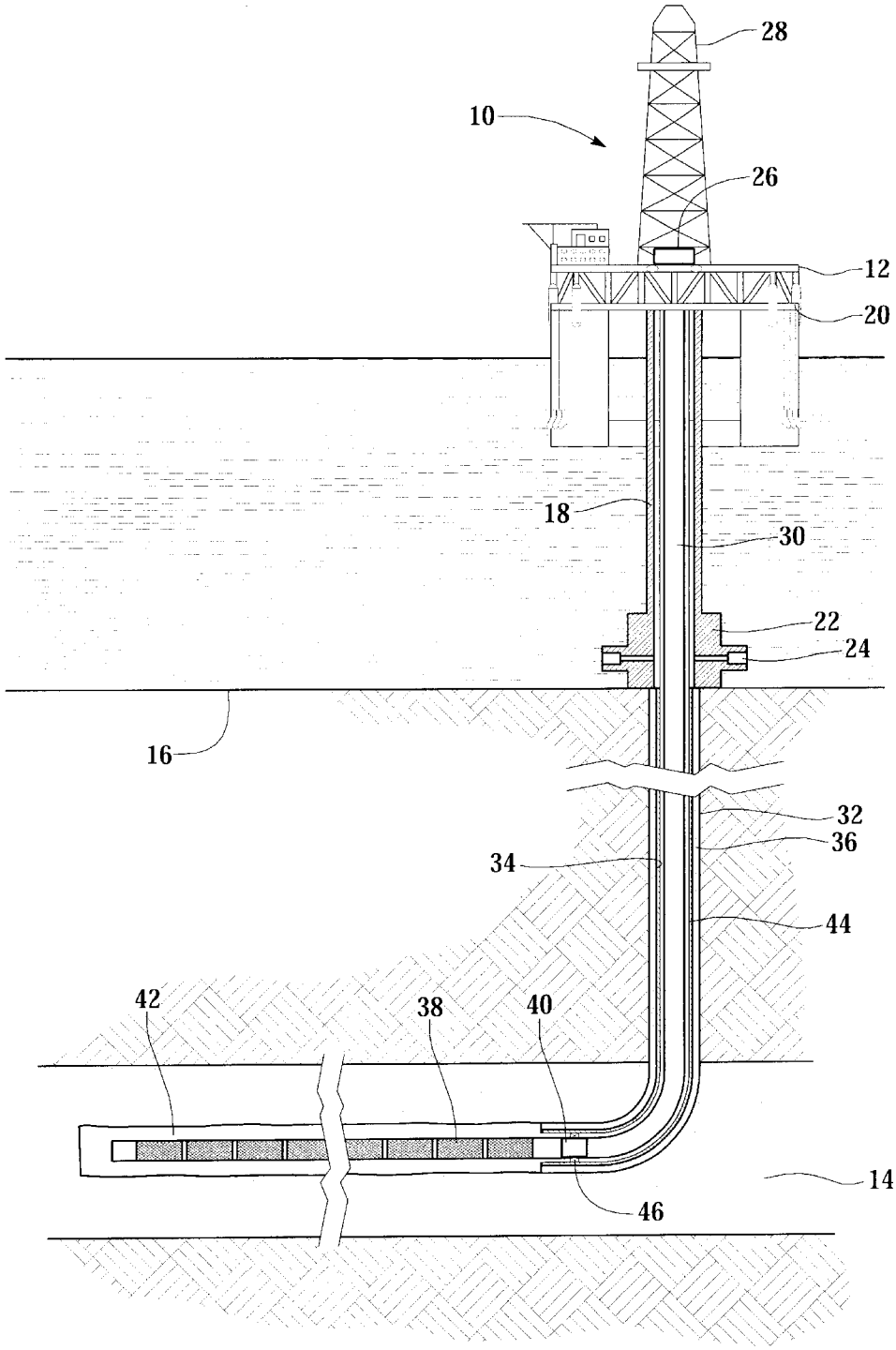
FIG. 1 is a schematic illustration of an offshore oil and gas platform operating an apparatus for gravel packing a horizontal open hole production interval of a wellbore of the present invention.

Referring initially to FIG. 1, an apparatus for gravel packing a horizontal open hole production interval of a wellbore operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within a portion of wellbore 32 by cement 36. Work string 30 extends beyond the end of casing 34 and includes a series of sand control screen assemblies 38 and a cross-over assembly 40 for gravel packing the horizontal open hole production interval 42 of wellbore 32. When it is desired to gravel pack production interval 42, work string 30 is lowered through casing 34 such that sand control screen assemblies 38 are suitably positioned within production interval 42. Thereafter, a fluid slurry including a liquid carrier and a particulate material such as sand, gravel or proppants is pumped down work string 30.

As explained in more detail below, the fluid slurry is injected into production interval 42 through cross-over assembly 40. Once in production interval 42, the gravel in the fluid slurry is deposited therein using the alpha-beta method wherein gravel is deposited on the low side of production interval 42 from the near end to the far end of production interval 42 then in the high side of production interval 42, on top of the alpha wave deposition, from the far end to the near end of production interval 42. While some of the liquid carrier may enter formation 14, the remainder of the liquid carrier travels through sand control screen assemblies 38, into a wash pipe (not pictured) and up to the surface via annulus 44 above packer 46.

Even though FIG. 1 and the following figures depict a horizontal wellbore and even through the term horizontal is being used to describe the orientation of the depicted wellbore, it should be understood by those skilled in the art that the present invention is equally well suited for use in wellbores that are inclined or deviated as well as horizontal. Accordingly, the use of the term horizontal herein is intended to include such inclined and deviated wellbores and is intended to specifically include any wellbore wherein it is desirable to use the alpha-beta gravel packing method.

Figure 2:
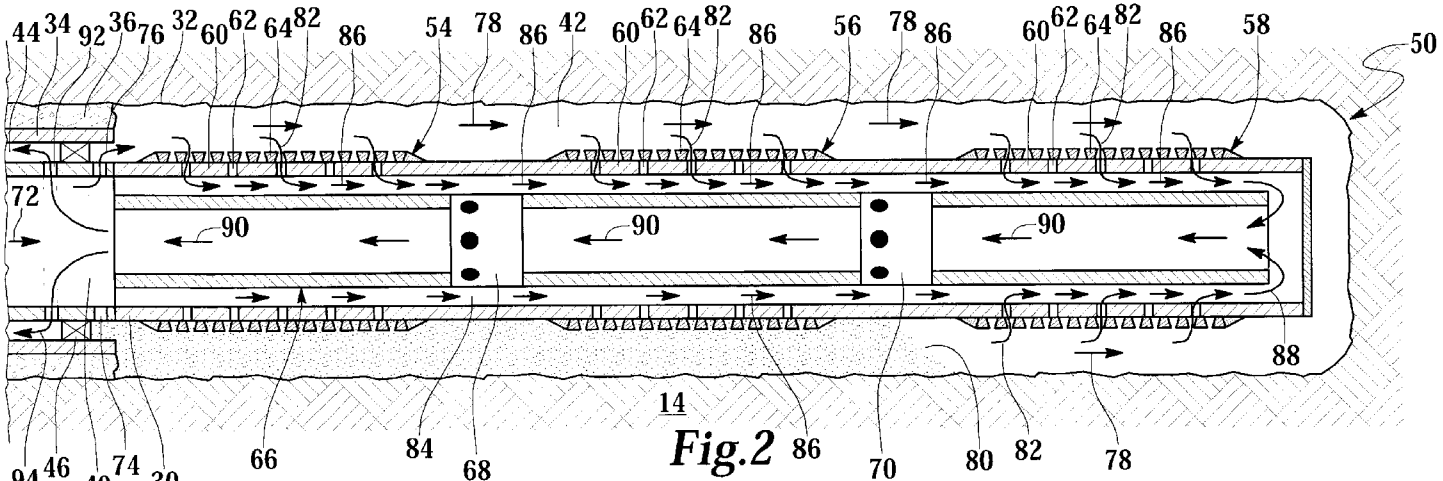
FIG. 2 is a half sectional view depicting the operation of an apparatus for gravel packing a horizontal open hole production interval of a wellbore of the present invention during the alpha wave.

Referring now to FIG. 2, therein is depicted a horizontal open hole production interval of a wellbore during an alpha wave portion of a gravel packing operation that is generally designated 50. Casing 34 is cemented within a portion of wellbore 32 proximate the heel or near end of wellbore 32. Work string 30 extends through casing 34 and into the open hole production interval 42 of wellbore 32. Packer assembly 46 is positioned between work string 30 and casing 34 at cross-over assembly 40. Work string 30 includes a plurality of sand control screen assemblies 54, 56, 58. Each of the sand control screen assemblies 54, 56, 58 includes a base pipe 60 that has a plurality of openings 62 which allow the flow of production fluids into the production tubing. The exact number, size and shape of openings 62 are not critical to the present invention, so long as sufficient area is provided for fluid production and the integrity of base pipe 60 is maintained.

Wrapped around each base pipe 60 is a screen wire 64. Screen wire 64 forms a plurality of turns with gaps therebetween through which formation fluids flow. The number of turns and the gap between the turns are determined based upon the characteristics of the formation from which fluid is being produced and the size of the gravel to be used during the gravel packing operation. Screen wire 64 may be wrapped directly on each of the base pipes 60 or may be wrapped around a plurality of ribs (not pictured) that are generally symmetrically distributed about the axis of each base pipe 60. The ribs may have any suitable cross sectional geometry including a cylindrical cross section, a rectangular cross section, a triangular cross section or the like. In addition, the exact number of ribs will be dependant upon the diameter of each base pipe 60 as well as other design characteristics that are well known in the art.

It should be understood by those skilled in the art that while FIG. 2 has depicted a wire wrapped sand control screen, other types of filter media could alternatively be used in conjunction with the apparatus of the present invention, including, but not limited to, a fluid-porous, particulate restricting, sintered metal material such as a plurality of layers of a wire mesh that are sintered together to form a porous sintered wire mesh screen designed to allow fluid flow therethrough but prevent the flow of particulate materials of a predetermined size from passing therethrough.

Disposed within work string 30 and extending from cross-over assembly 40 is a wash pipe assembly 66. Wash pipe assembly 66 extends substantially to the far end of work string 30 near the toe of production interval 42. Wash pipe assembly 66 includes a pair of differential pressure valves 68, 70 that are spaced at intervals along wash pipe assembly 66. As will be explained in greater detail below, differential pressure valves 68, 70 provide a path for return fluids that reduces the friction pressure required to place the beta wave portion of the gravel pack in horizontal production interval 42 of wellbore 32, thereby reducing the risk of unintentionally fracturing formation 14.

During a gravel packing operation, the objective is to uniformly and completely fill horizontal production interval 42 with gravel. This is achieved by pumping a fluid slurry containing gravel down work string 30 into cross-over assembly 40 along the path indicated by arrow 72. The fluid slurry containing gravel exits cross-over assembly 40 through cross-over ports 74 and is discharged into horizontal production interval 42 as indicated by arrow 76. In the illustrated embodiment, the fluid slurry containing gravel then travels within production interval 42 as indicated by arrows 78 with portions of the gravel dropping out of the slurry and building up on the low side of wellbore 32 from the heel to the toe of wellbore 32 as indicated by alpha wave front 80 of the alpha wave portion of the gravel pack. At the same time, portions of the carrier fluid of the fluid slurry pass through sand control screen assemblies 54, 56, 58, as indicated by arrows 82 and travel through annulus 84 between wash pipe assembly 66 and the interior of sand control screen assemblies 54, 56, 58, as indicated by arrows 86. These return fluids enter the far end of wash pipe assembly 66, as indicated by arrows 88, flow back through wash pipe assembly 66 to cross-over assembly 40, as indicated by arrows 90, and flow into annulus 44 through cross-over ports 92 along the paths indicated by arrows 94 for return to the surface.

The propagation of alpha wave front 80 continues from the heel to the toe of horizontal production interval 42. During the propagation of alpha wave front 80, the open hole volume within horizontal production interval 42 decreases which increases the friction pressure of the system as more of the carrier fluid is forced into the remaining open parts of production interval 42 above the alpha wave and the relatively small annulus 84. During the alpha wave portion of the gravel packing operation the increase in friction pressure is not significant. During the beta wave portion of the gravel packing operation, however, the increase in friction pressure becomes significant. In fact, the friction pressure required to gravel pack horizontal production interval 42 may exceed the fracture pressure of formation 14. If formation 14 is fractured, significant fluid loss into formation 14 may occur which will result in an incomplete gravel pack.

Figure 3:
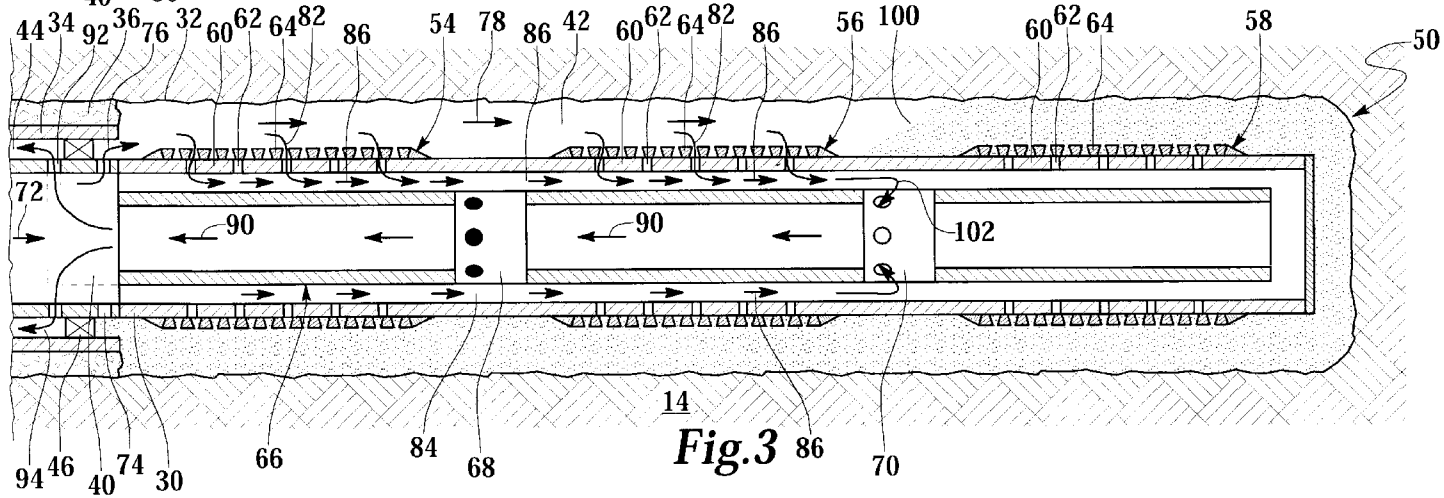
FIG. 3 is a half sectional view depicting the operation of an apparatus for gravel packing a horizontal open hole production interval of a wellbore of the present invention at a first progression of the beta wave.

Using differential pressure valves 68, 70 of the present invention, however, the friction pressure required to gravel pack horizontal production interval 42 is maintained below the fracture pressure of formation 14. Specifically, as seen in FIG. 3, following the completion of the alpha wave portion of the gravel pack, portions of the gravel dropping out of the slurry build up on the high side of wellbore 32 from the toe to the heel of wellbore 32, as indicated by beta wave front 100 of the beta wave portion of the gravel pack. As beta wave front 100 approaches the location of differential pressure valve 70, the difference in pressure upstream of differential pressure valve 70 compared to downstream of differential pressure valve 70 increases. Specifically, prior to the arrival of beta wave front 100, only about ten to twenty percent of the carrier fluid may be flowing through annulus 84 at differential pressure valve 70 while about eighty to ninety percent of the carrier fluid, along with the suspended gravel, will be flowing in the portion of production interval 42 adjacent to differential pressure valve 70. Once beta wave front 100 reached the hole location of differential pressure valve 70, however, about eighty to ninety percent of the carrier fluid will be forced into annulus 84 upstream of differential pressure valve 70 with about ten to twenty percent traveling in the tightly packed region in the portion of production interval 42 adjacent to differential pressure valve 70. Accordingly, there will be a significant increase in the upstream-downstream differential pressure across differential pressure valve 70.

When the upstream-downstream differential pressure exceeds a preselected magnitude, differential pressure valve 70 actuates such that the return fluids in annulus 84 no longer have to travel to the far end of wash pipe assembly 66 but instead enter wash pipe assembly 66 through differential pressure valve 70, as indicated by arrows 102. Accordingly, the friction pressure of the system is reduced by eliminating the friction associated with the return fluids traveling in annulus 84 from differential pressure valve 70 to the far end of wash pipe assembly 66 and the friction associated with the return fluids traveling in wash pipe assembly 66 from the far end to differential pressure valve 70.

The sensing points for the upstream-downstream differential pressure may be in annulus 84 immediately upstream and downstream of differential pressure valve 70 or may be spaced a greater distance apart in annulus 84 to provide a greater differential pressure. The upstream-downstream differential pressure may be transmitted to differential pressure valve 70 via a pair of control lines that are in direct communication with the fluid upstream and downstream of differential pressure valve 70. Alternatively, other types of pressure sensors may be used, including, but not limited to, electronic pressure sensors, optical pressure sensors and the like. Using such pressure sensors, the differential pressure data may be sent directly to differential pressure valve 70 for actuation when the upstream-downstream differential pressure exceeds a preselected magnitude. Alternatively, the pressure readings may be sent to the surface such that an actuation signal may be sent from the surface to differential pressure valve 70.

Figure 4:
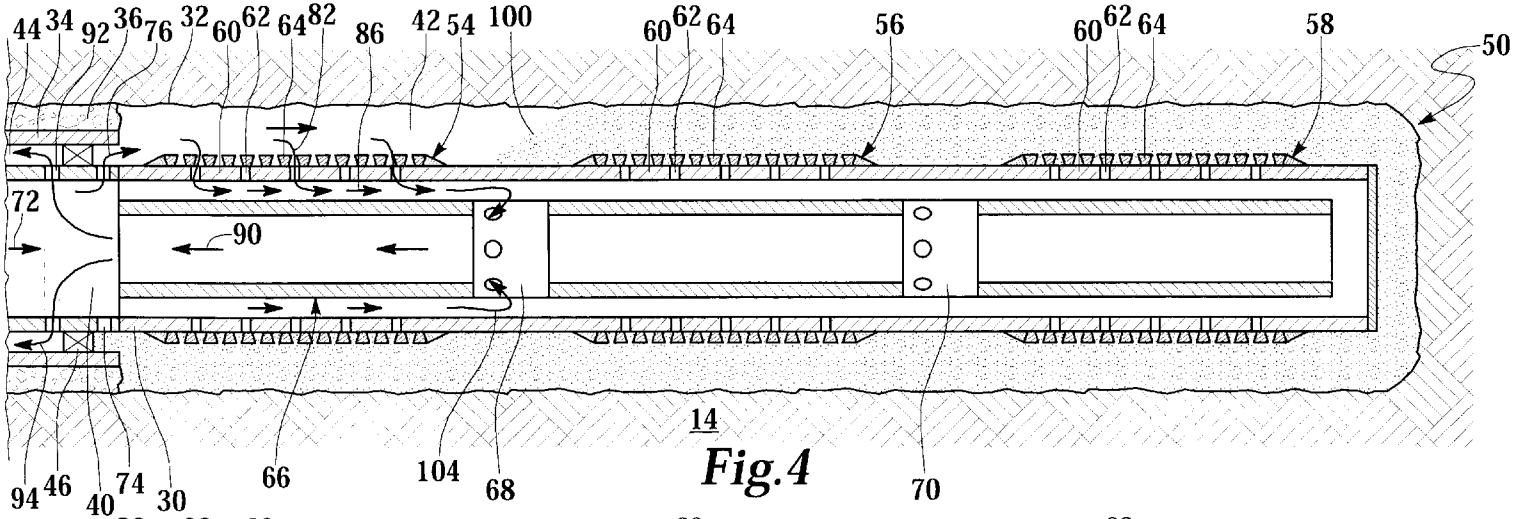
FIG. 4 is a half sectional view depicting the operation of an apparatus for gravel packing a horizontal open hole production interval of a wellbore of the present invention at a second progression of the beta wave.

As seen in FIG. 4, as beta wave front 100 approaches the hole location of differential pressure valve 68, the difference in pressure upstream of differential pressure valve 68 compared to downstream of differential pressure valve 68 increases. When the upstream-downstream differential pressure exceeds a preselected magnitude, differential pressure valve 68 actuates such that the return fluids in annulus 84 no longer have to travel to differential pressure valve 70 but instead enter wash pipe assembly 66 through differential pressure valve 68, as indicated by arrows 104. Accordingly, the friction pressure of the system is again reduced by eliminating the friction associated with the return fluids traveling in annulus 84 from differential pressure valve 68 to differential pressure valve 70 and traveling in wash pipe assembly 66 from differential pressure valve 70 to differential pressure valve 68.

Again, the sensing points for the upstream-downstream differential pressure may be in annulus 84 immediately upstream and downstream of differential pressure valve 68 or may be spaced a greater distance apart in annulus 84 to provide a greater differential pressure. Also, upstream-downstream differential pressure may be transmitted to differential pressure valve 68 via a pair of control lines that are in direct communication with the fluid upstream and downstream of differential pressure valve 68 or may be sensed using other types of pressure sensors directly coupled to differential pressure valve 68 or via surface communications.

Figure 5:
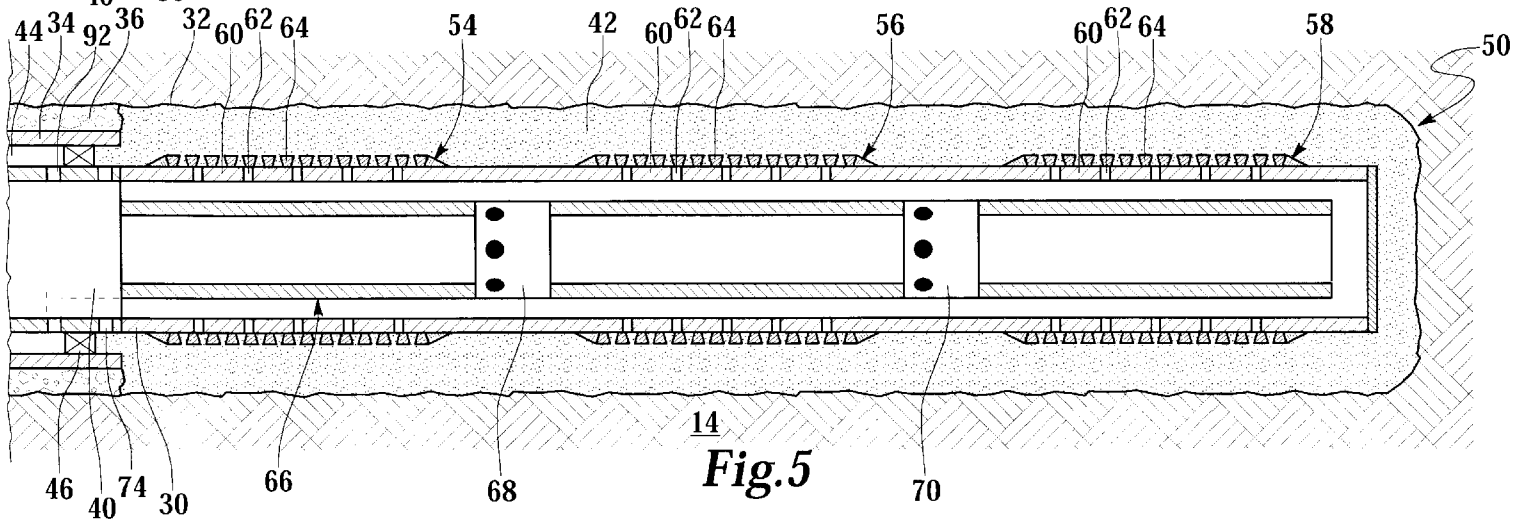
FIG. 5 is a half sectional view depicting the operation of an apparatus for gravel packing a horizontal open hole production interval of a wellbore of the present invention following the gravel packing operation.

Alternatively, the operation of differential pressure valve 68 may be triggered by the operation of differential pressure valve 70. For example, differential pressure valve 70 may send a signal to differential pressure valve 68 which starts a timer such that differential pressure valve 68 actuates at a predetermined time after differential pressure valve 70 actuates. Alternatively, after the actuation of differential pressure valve 70, differential pressure valve 70 may send a signal to differential pressure valve 68 to instruct differential pressure valve 68 to begin sensing pressure. In either case, providing communication between the various differential pressure valves positioned within wash pipe assembly 66 will assure the proper sequence of operation as beta wave front 100 progresses from the toe of wellbore 32 to the heel of wellbore 32 such that the entire horizontal production interval 42 may be tightly packed with gravel, as best seen in FIG. 5. In addition, differential pressure valves 68, 70 may be closed following the completion of the gravel pack operation to allow for other well treatment operations, such as an acid treatment prior to removal of wash pipe assembly 66. Alternatively or additionally, differential pressure valves 68, 70 may be one-way valves that allow fluid flow only from the exterior to the interior of differential pressure valves 68, 70.

Even though FIGS. 2–5 have described differential pressure valves 68, 70 as being operated based upon the upstream-downstream differential pressure, it should be understood by those skilled in the art that other parameters may be used to trigger the actuation of valves positioned in wash pipe assembly 66. For example, the change in the density in production interval 42 at a hole location proximate the valve could alternatively be used to trigger valve actuation. Specifically, as the composition of the constituent in production interval 42 at a hole location proximate the valve changes from a fluid slurry to a gravel pack as the beta wave progresses past this location, the density at this location significantly increases. Accordingly, by sensing the density at this location, valve actuation can be triggered when the beta wave is proximate the valve. Other parameters such as absolute pressure, absolute temperature, upstream-downstream differential temperature, flow velocity in annulus 84 adjacent the valves and the like could also be used to trigger the actuation of such a valve.

Figure 6:
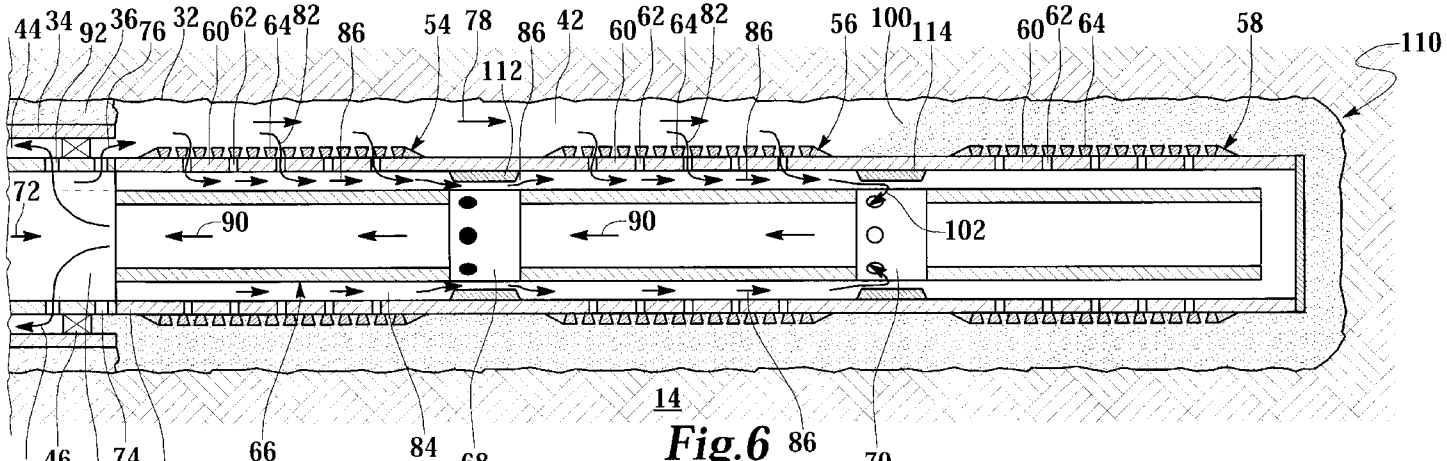
FIG. 6 is a half sectional view depicting the operation of another embodiment of an apparatus for gravel packing a horizontal open hole production interval of a wellbore of the present invention at a first progression of the beta wave.

Referring now to FIG. 6, therein is depicted a horizontal open hole production interval of a wellbore during a beta wave portion of a gravel packing operation that is generally designated 110. As with the embodiment of FIGS. 2–5, in this embodiment, casing 34 is cemented within a portion of wellbore 32 proximate the heel of wellbore 32 with work string 30 extending through casing 34 and into the open hole production interval 42 of wellbore 32. Packer assembly 46 is positioned between work string 30 and casing 34 at cross-over assembly 40. Work string 30 includes a plurality of sand control screen assemblies 54, 56, 58. In addition, work string 30 includes a pair of restrictor members 112, 114.

Disposed within work string 30 and extending from cross-over assembly 40 is a wash pipe assembly 66. Wash pipe assembly 66 extends substantially to the far end of work string 30 near the toe of wellbore 32. Wash pipe assembly 66 includes a pair of differential pressure valves 68, 70 that are spaced at intervals along wash pipe assembly 66 and are substantially aligned with restrictor members 112, 114, respectively.

During a gravel packing operation, after the alpha wave portion of the gravel pack is complete and beta wave front 100 approaches the location of differential pressure valve 70, the upstream-downstream differential pressure relative to differential pressure valve 70 is measured in annulus 84. When the upstream-downstream differential pressure exceeds a preselected magnitude, differential pressure valve 70 actuates such that the return fluids in annulus 84 may enter wash pipe assembly 66 through differential pressure valve 70, as indicated by arrows 102. In this embodiment, the upstream-downstream differential pressure is intensified due to the restricted flow area created by restrictor members 112, 114.

In the illustrated embodiment, restrictor members 112, 114 have radially reduced inner diameters that choke the flow of the return fluids that are traveling through annulus 84. This choking of the flow creates an additional pressure drop which allows the preselected magnitude of the upstream-downstream differential pressure to be increased. Importantly, restrictor members 112, 114 only choke the flow of return fluids but do not prevent the flow of the return fluids in annulus 84. If restrictor members 112, 114 prevented the flow of the return fluids in a portion of annulus 84, this would create a discontinuity in the gravel pack in production interval 42 adjacent to restrictor members 112, 114. Such a failure to properly gravel pack the entire production interval 42 could allow particulate matter to be produced once hydrocarbon production commences.

Figure 7:
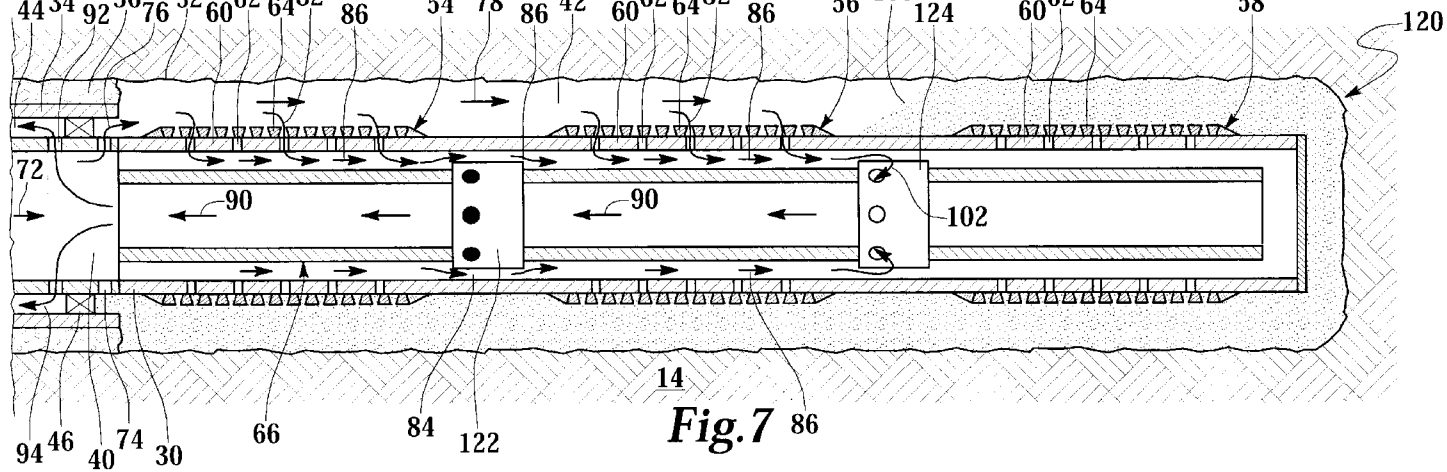
FIG. 7 is a half sectional view depicting the operation of another embodiment of an apparatus for gravel packing a horizontal open hole production interval of a wellbore of the present invention at a first progression of the beta wave.

In a similar manner, the flow of the return fluids traveling through annulus 84 may be choked by adding restrictor members to the outer surface of wash pipe assembly 66 or by simply installing larger outer diameter differential pressure valves, such as differential pressure valves 122, 124, as best seen in FIG. 7. Increasing the outer diameter of portions of wash pipe assembly 66 also chokes the flow and creates additional pressure drop which allows the preselected magnitude of the upstream-downstream differential pressure to be increased.

Even though restrictor members 112, 114 and larger outer diameter differential pressure valves 122, 124 have been depicted as separate embodiments, it should be understood by those skilled in the art that a restrictor member and a larger outer diameter differential pressure valve or two opposing restrictor members may be used together to achieve the desired choking of the return fluid flow, without departing from the principle of the present invention. Also, even though FIG. 6 has depicted differential pressure valves 68, 70 as being substantially aligned with restrictor members 112, 114, it should be understood by those skilled in the art that other relative positions that create suitable pressure drops are possible and are considered within the scope of the present invention.

Figure 8:
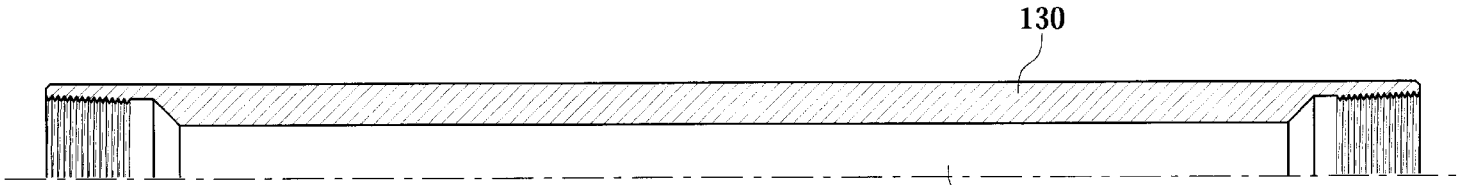
FIG. 8 is a cross sectional view of one embodiment of a restrictor member of an apparatus for gravel packing a horizontal open hole production interval of a wellbore of the present invention.

Referring now to FIG. 8, therein is depicted a cross sectional view of a restrictor member for choking the flow of return fluids that is generally designated 130. Restrictor member 130 is a substantially tubular pipe joint that is threadably attachable within work string 30. Relative to the other joints of pipe that make up work string 30, however, restrictor member 130 has a radially reduced inner diameter 132. Accordingly, there is a greater restriction to flow through an area including restrictor member 130 as compared to an area having typical inner diameter pipe sections.

Figure 9:
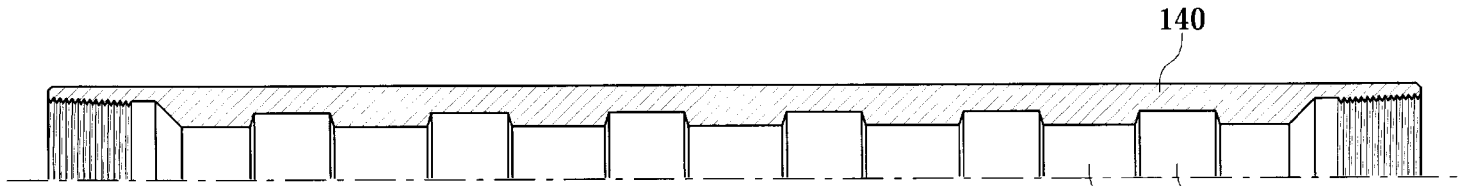
FIG. 9 is a cross sectional view of another embodiment of a restrictor member of an apparatus for gravel packing a horizontal open hole production interval of a wellbore of the present invention.

To further increase the pressure drop across a given region of annulus 84, turbulizing members that cause turbulence in the flow of the return fluids may be used in place of or in conjunction with an inner diameter reduction. Specifically, as seen in FIG. 9, restrictor member 140 has a series of radially reduced regions 142 and a series of notches 144. This pattern in the inner diameter of restrictor member 140 causes turbulence in the flow of the return fluids, thereby creating additional pressure drop which allows the preselected magnitude of the upstream-downstream differential pressure to be increased. In addition, notches 144 serve as sand grooves that help prevent wash pipe assembly 66 from becoming stuck in work string 30.

Figure 10:
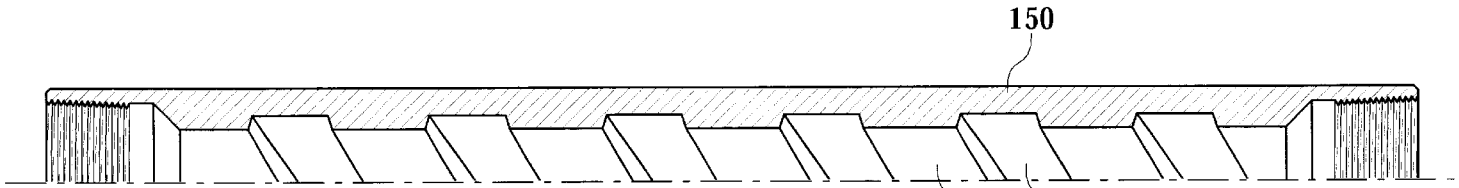
FIG. 10 is a cross sectional view of another embodiment of a restrictor member of an apparatus for gravel packing a horizontal open hole production interval of a wellbore of the present invention.
Figure 11:
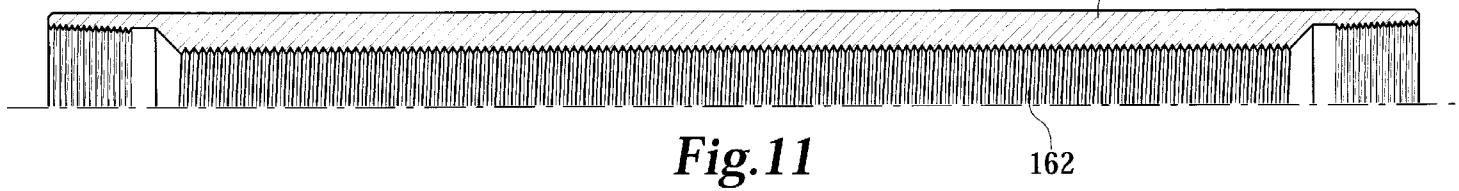
FIG. 11 is a cross sectional view of another embodiment of a restrictor member of an apparatus for gravel packing a horizontal open hole production interval of a wellbore of the present invention.

Another embodiment of a turbulence generating restrictor member is depicted in FIG. 10 and is general designated 150. Restrictor member 150 has a series of radially reduced regions 152 and a series of notches 154 that form a series of spiral paths that impart circumferential momentum into the return fluid to create turbulence in the flow and also serve as sand grooves. Likewise, restrictor member 160 of FIG. 11 has a rough inner diameter 162 created, for example, by threading or knurling the inner surface of restrictor member 160. This rough surface causes turbulence in the flow of the return fluids which again increases the pressure drop which allows the preselected magnitude of the upstream-downstream differential pressure to be increased.

Figure 12:
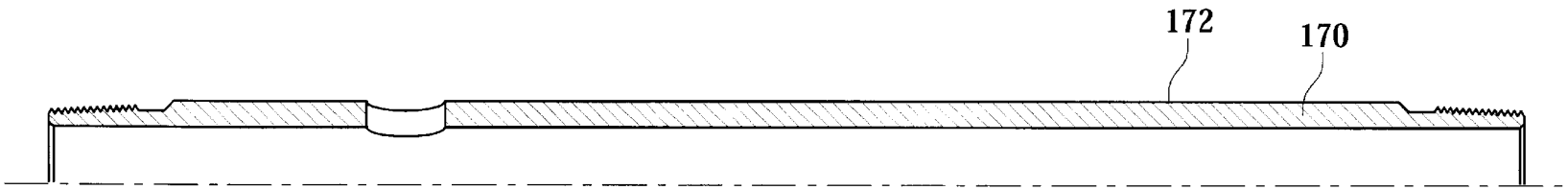
FIG. 12 is a cross sectional view of one embodiment of a restrictor member of an apparatus for gravel packing a horizontal open hole production interval of a wellbore of the present invention.

Referring now to FIG. 12, therein is depicted a cross sectional view of a restrictor member for choking the flow of return fluids that is generally designated 170. Restrictor member 170 is a substantially tubular pipe joint that is threadably attachable within wash pipe assembly 66 or may represent an outer housing of a differential pressure valve. In either case, relative to the other joints of pipe that make up wash pipe assembly 66, restrictor member 170 has a radially increased outer diameter 172. Accordingly, there is a greater restriction to flow through an area including restrictor member 170 as compared to the other pipe joints that make up wash pipe assembly 66.

Figure 13:
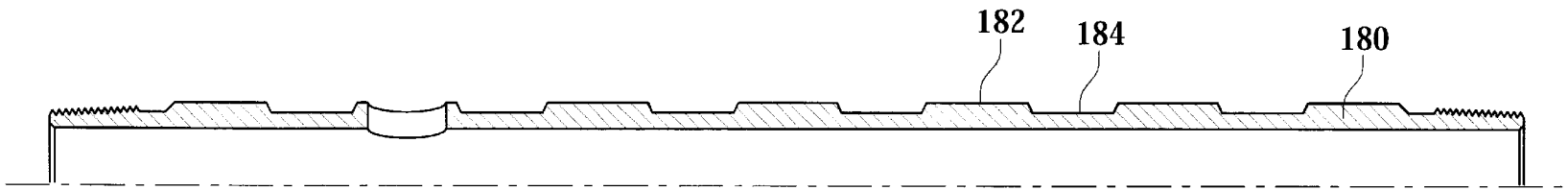
FIG. 13 is a cross sectional view of another embodiment of a restrictor member of an apparatus for gravel packing a horizontal open hole production interval of a wellbore of the present invention.
Figure 14:
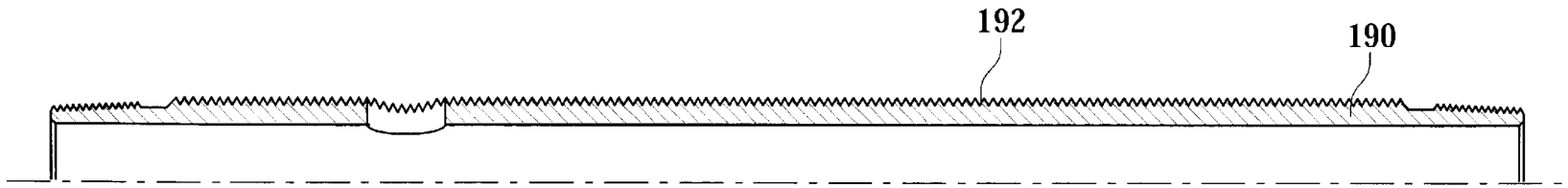
FIG. 14 is a cross sectional view of another embodiment of a restrictor member of an apparatus for gravel packing a horizontal open hole production interval of a wellbore of the present invention.

As explained above, to further increase the pressure drop across a given region of annulus 84, restrictor members that cause turbulence in the flow of the return fluids may be used in place of or in conjunction with an increase in outer diameter. Specifically, as seen in FIG. 13, restrictor member 180 has a series of radially increased regions 182 and a series of notches 184 that may be set in a square pattern, a spiral pattern or other pattern that is suitable for creating turbulence. These notches 184 also serve as sand grooves, as explained above. Likewise, restrictor member 190 of FIG. 14 has a rough outer diameter 192 created, for example, by threading or knurling the outer surface of restrictor member 190 which creates turbulence.

Figure 15:
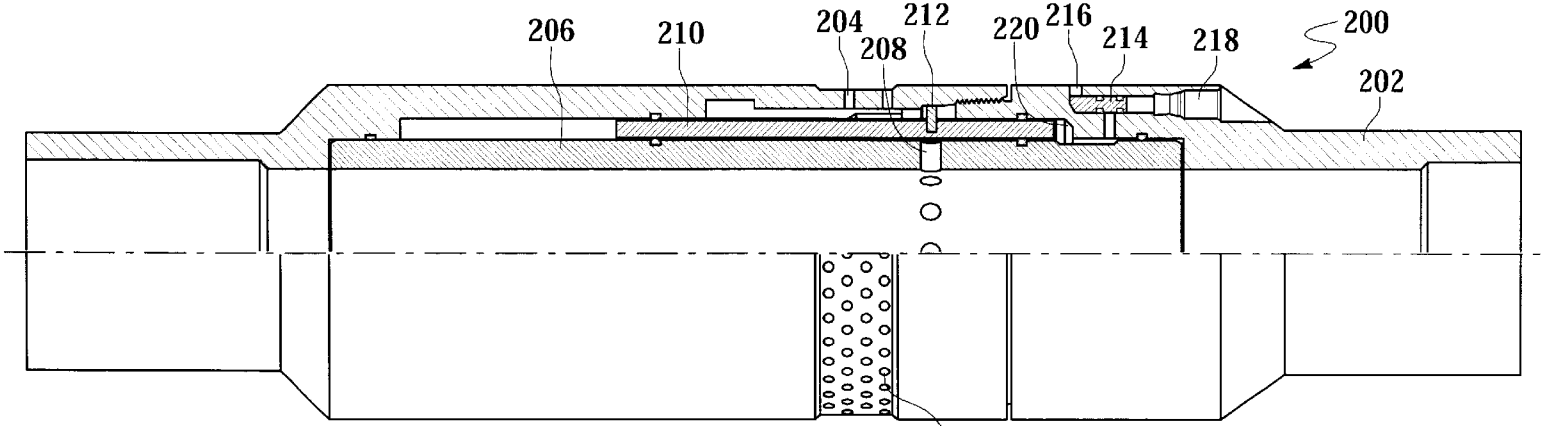
FIG. 15 is a quarter sectional view of one embodiment of a differential pressure valve in the closed position for use in an apparatus for gravel packing a horizontal open hole production interval of a wellbore of the present invention.
Figure 16:
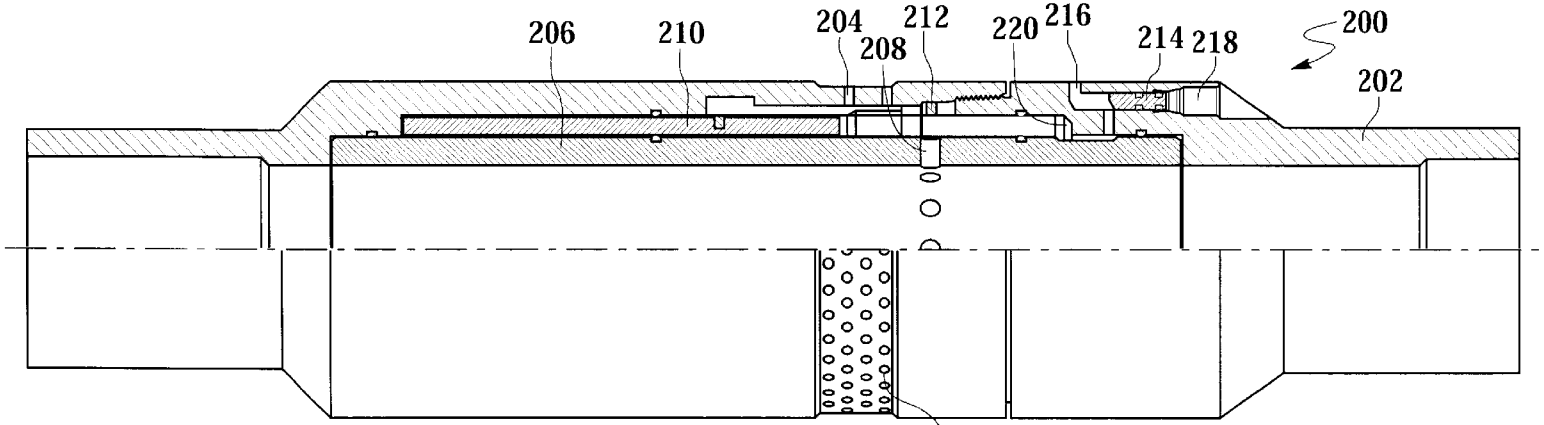
FIG. 16 is a quarter sectional view of one embodiment of a differential pressure valve in the open position for use in an apparatus for gravel packing a horizontal open hole production interval of a wellbore of the present invention.

Referring now to FIGS. 15 and 16, therein is depicted a differential pressure valve of the present invention that is generally designated 200. Differential pressure valve 200 has an outer housing 202 that includes a plurality of ports 204. Disposed on the interior of outer housing 202 is a mandrel 206 that includes a plurality of ports 208. Slidably and sealingly disposed between outer housing 202 and mandrel 206 is a sliding sleeve 210. Sliding sleeve 210 is initially fixed relative to outer housing 202 by shear member 212. Slidably and sealingly disposed within a sidewall bore of outer housing 202 is a piston 214. Piston 214 is in communication with the pressure upstream of differential pressure valve 200 via port 216. Likewise, piston 214 is in communication with the pressure downstream of differential pressure valve 200 via port 218.

As described above, the actual sensing points for the upstream and downstream pressures may be immediately upstream and downstream of differential pressure valve 200 or may be spaced a greater distance apart to provide a greater differential pressure in which case, a control line may be coupled to port 216, port 218 or both and extended to the desired pressure sensing locations and to provide direct communication with the fluid upstream and downstream of differential pressure valve 200 at those locations. In the illustrated embodiment, when the upstream-downstream differential pressure exceeds the level necessary to shift piston 214 from the position shown in FIG. 15 to the positioned shown in FIG. 16, pressure from annulus 84 is allowed to act on sliding sleeve 210 by entering chamber 220 via port 216 and the sidewall bore of outer housing 202. This fluid pressure is sufficient to break shear member 212 which allows sliding sleeve 210 to shift axially relative to outer housing 202 and mandrel 206. Once differential pressure valve 200 is in this open position, as best seen in FIG. 16, fluid communication is allowed from the exterior to the interior of differential pressure valve 200 through ports 204, chamber 220 and ports 208.

Figure 17:
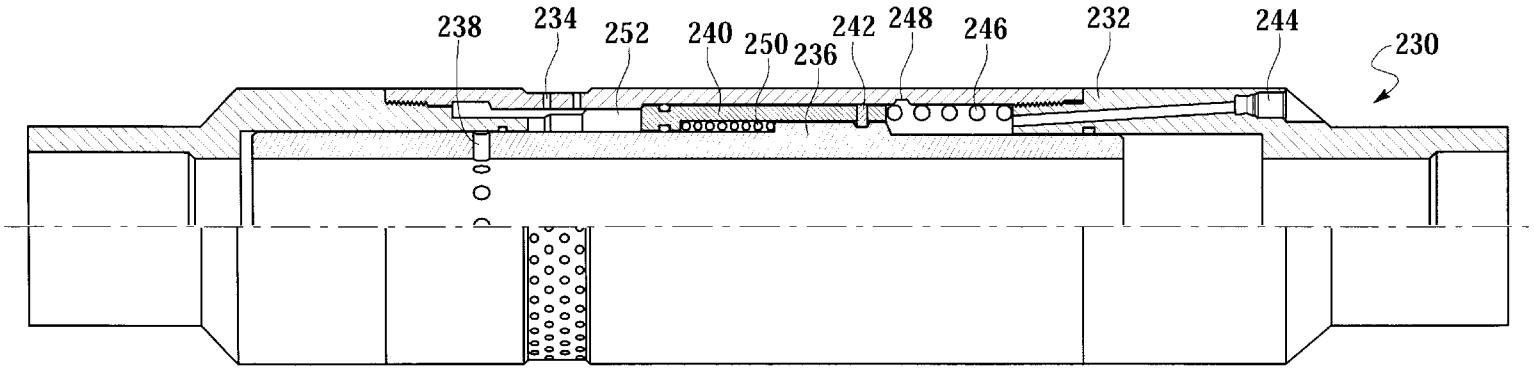
FIG. 17 is a quarter sectional view of another embodiment of a differential pressure valve in the closed position for use in an apparatus for gravel packing a horizontal open hole production interval of a wellbore of the present invention.
Figure 18:
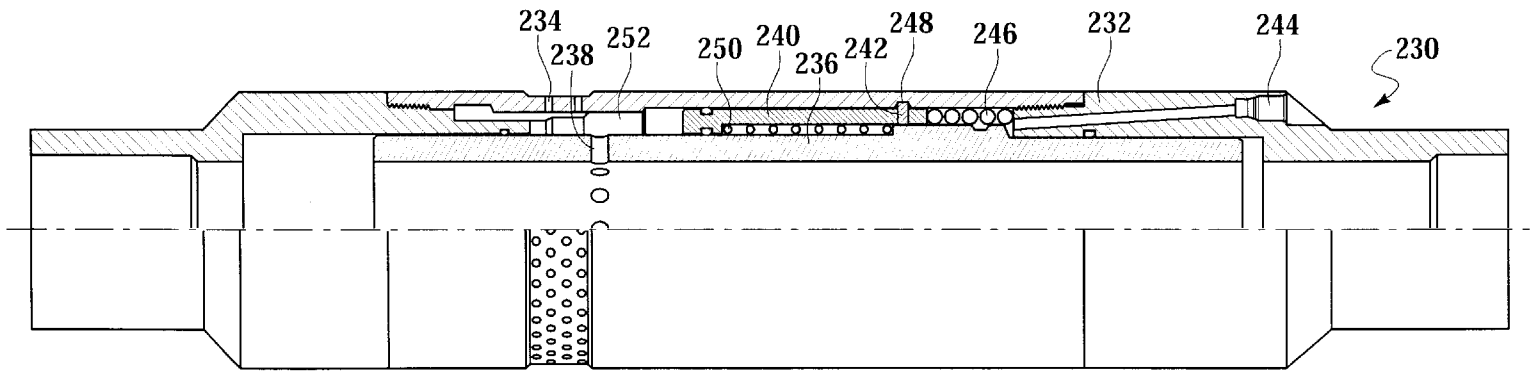
FIG. 18 is a quarter sectional view of another embodiment of a differential pressure valve in the open position for use in an apparatus for gravel packing a horizontal open hole production interval of a wellbore of the present invention.

Referring now to FIGS. 17 and 18, therein is depicted another embodiment of a differential pressure valve of the present invention that is generally designated 230. Differential pressure valve 230 has an outer housing 232 that includes a plurality of ports 234. Slidably and sealingly disposed on the interior of outer housing 232 is a sliding sleeve 236 that includes a plurality of ports 238. Also, slidably and sealingly disposed within outer housing 232 is a piston 240. Piston 240 is initially fixed relative to sliding sleeve 236 by lock member 242. Piston 240 is in communication with the pressure upstream of differential pressure valve 230 via ports 234. Likewise, piston 240 is in communication with the pressure downstream of differential pressure valve 230 via port 244.

In the illustrated embodiment, when the upstream pressure exceeds the downstream pressure by the amount necessary to compress spring 246, piston 240 and sliding sleeve 236 travel together until lock member 242 is aligned with detent 248. Lock member 242 then releases from sliding sleeve 236 and locks piston 240 relative to outer housing 232. At the same time, spring 250 urges sliding sleeve 236 to the position shown in FIG. 18. Once differential pressure valve 230 is in this open position, fluid communication is allowed from the exterior to the interior of differential pressure valve 230 through ports 234, chamber 252 and ports 238.

Referring now to FIGS. 19A, 19B, 20A and 20B, therein are depicted another embodiment of a differential pressure valve of the present invention that is generally designated 260. Differential pressure valve 260 includes an outer housing 262. Outer housing 262 includes a threaded upper connector 264 that may be threadably coupled to a section of wash pipe. Upper connector 264 is threadably and sealably attached to main housing section 266. Main housing section 266 is threadably and sealably coupled to a lower connector 268. Lower connector 268 is threadably attachable to another section of wash pipe. Lower connector 268 is also coupled to a lower connector extension 270 via lug 272.

Main housing section 266 includes a plurality of openings 274 that are circumferentially spaced around main housing section 266. The exact number and size of openings 274 are not critical to the present invention so long as a suitable flow area is provided and the integrity of main housing section 266 is maintained. Main housing section 266 serves as a restrictor member as the outer diameter of portions of main housing section 266 have radially increased regions 276 relative to the other portions of the wash pipe assembly attached to either end of differential pressure valve 260. Accordingly, the radially increased regions 276 of main housing section 266 create a greater restriction to flow as compared to the other pipe joints that make up the wash pipe assembly. To further increase the pressure drop across differential pressure valve 260, main housing section 266 also has a series of notches 278 that create turbulence in the fluids flowing thereacross. Notches 278 also serve as sand grooves which prevent differential pressure valve 260 from becoming stuck within a sand control screen assembly.

In the illustrated embodiment, main housing section 266 includes a vent port 280 that is initially in fluid communication with openings 274. An annular region 282 is defined between main housing section 266 and a portion of lower connector 268. Annular region 282 is in fluid communication with a fluid passageway 284 that extends through lower connector 268 and is in fluid communication with the exterior of differential pressure valve 260.

Upper connector 264 includes an upper connector extension 286 that has a plurality of windows 288. The lower end of upper connector extension 286 is a spring retainer 290. Disposed between a portion of upper connector 264 and main housing section 266 is a bladder 292. Bladder 292 selectively provides a seal against openings 274 such that fluid flow is prevented from the interior to the exterior of main housing section 266 through openings 274. At the same time, bladder 292 allows for fluid flow from the exterior to the interior of main housing section 266 through openings 274. Accordingly, bladder 292 provides for one way flow through openings 274, the flow being from the exterior to the interior of main housing section 266.

Slideably and sealably disposed within upper connector extension 286 and lower connector extension 270 is a sleeve 294. Sleeve 294 has a longitudinal bore extending therethrough which allows for the flow of return fluids therethrough. In addition, sleeve 294 has a plurality of openings 296 that are circumferentially spaced around sleeve 294 near the upper end of sleeve 294. The exact size and number of openings 296 are not critical to the present invention so long as a suitable flow area is established and the integrity of sleeve 294 is maintained.

Deposed between sleeve 294 and main housing section 266, from top to bottom, are main spring 298, main spring carrier 300, piston 302, adjustable nut 304, piston spring 306 and piston spring carrier 308. Main spring carrier 300 is fixed relative to sleeve 294 by a lug 310. A lug 312 extends radially outwardly from main spring carrier 300 and initially rest against shoulder 314 of main housing section 266. Lug 312 is radially outwardly supported by an upper extension of piston 302. Piston 302 includes a pair of O-rings 316, 318. O-ring 318 provides a seal between piston 302 and main housing section 266. O-ring 316, however, initially does not provide a seal between piston 302 and main housing section 266 such that there is fluid communication between openings 274 and vent port 280. Piston 302 includes an additional O-ring 320 that provides a seal between sleeve 294 and piston 302. Piston spring carrier 308 is fixed relative to sleeve 294 by a lug 322. The upward bias force of piston spring 306 can be regulated by rotating adjustable nut 304. Regulating the bias force allows for the control of the amount of differential pressure required to operate differential pressure valve 260 from the closed position to the open position as described below.

Figure 19A:
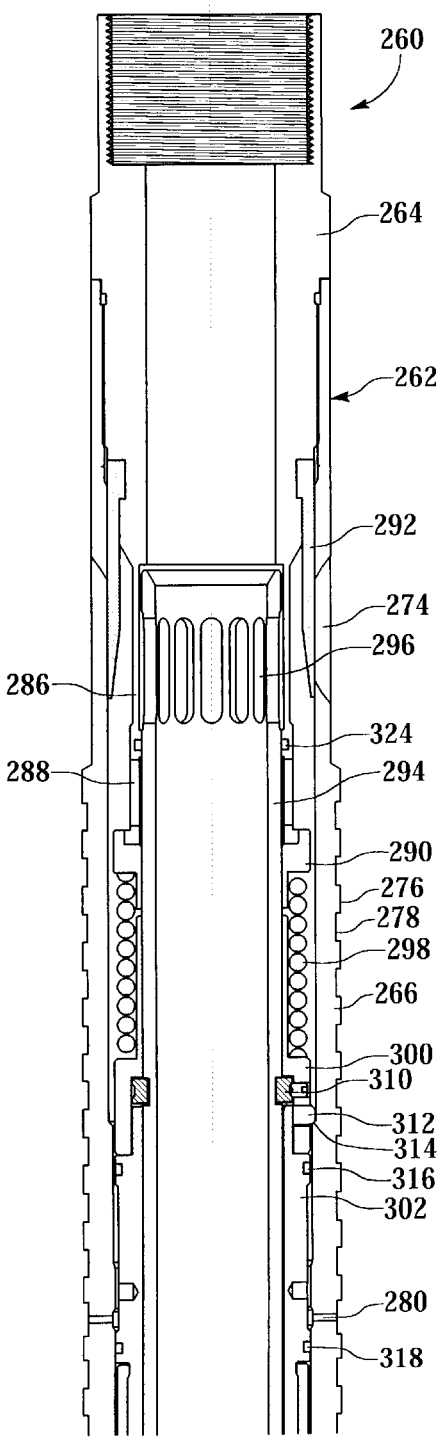
FIGS. 19A–19B are half sectional views of another embodiment of a differential pressure valve in the closed position for use in an apparatus for gravel packing a horizontal open hole production interval of a wellbore of the present invention.
Figure 20A:
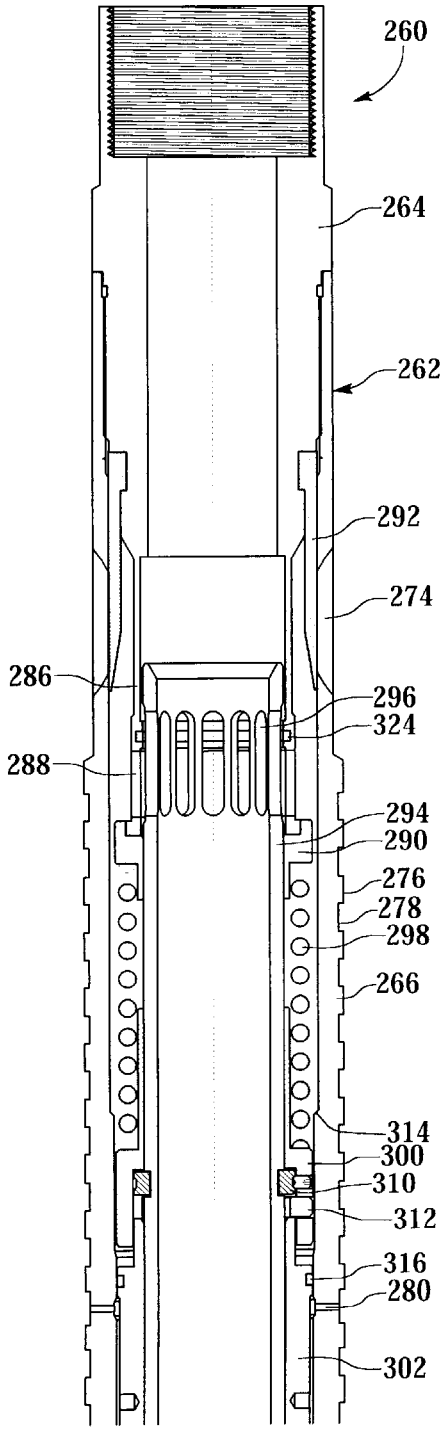
FIGS. 20A–20B are half sectional views of another embodiment of a differential pressure valve in the open position for use in an apparatus for gravel packing a horizontal open hole production interval of a wellbore of the present invention.
Figure 19B:
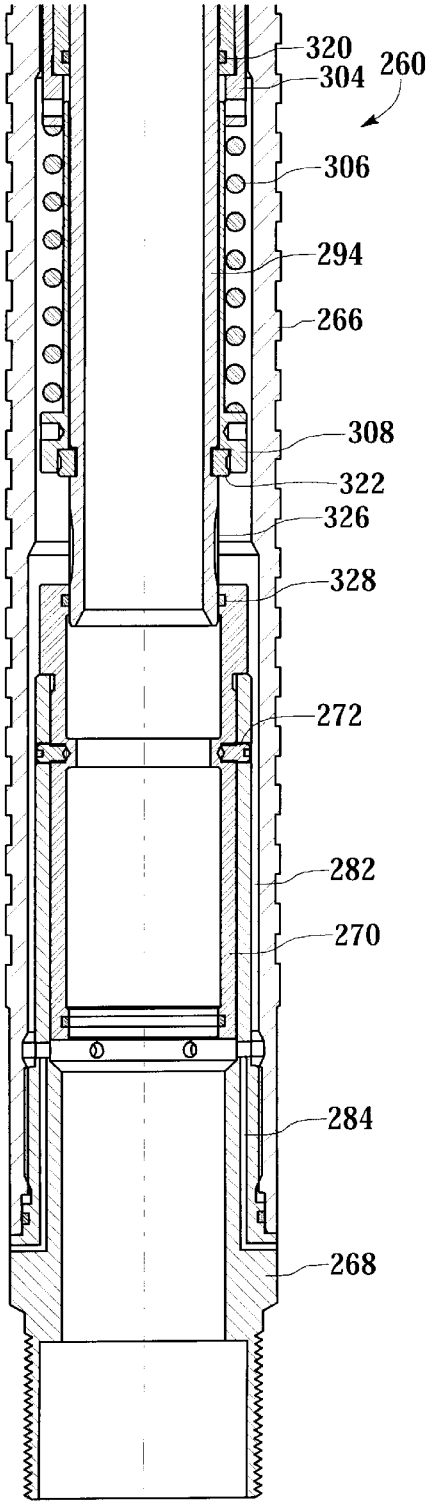
Figure 20B:
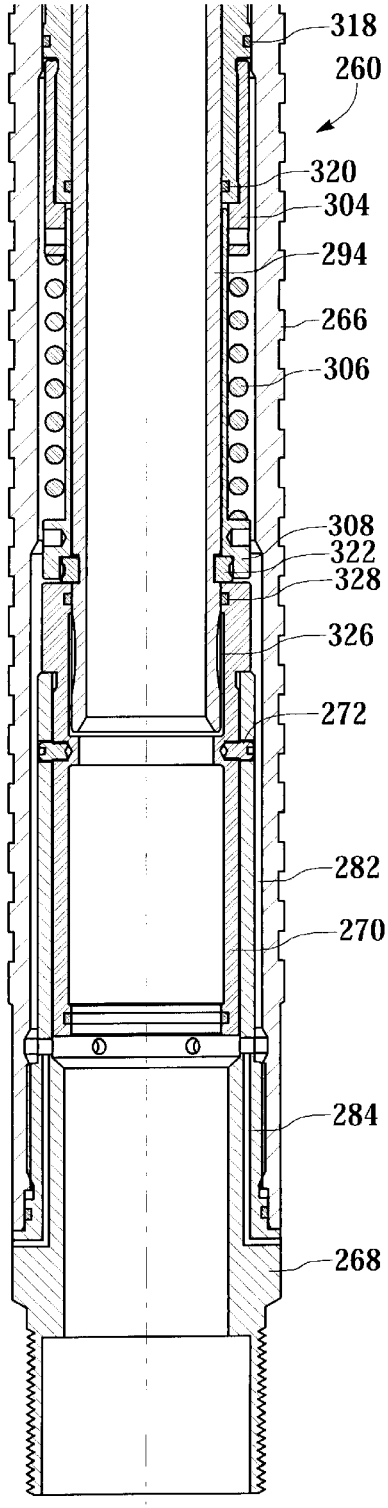

In operation, once differential pressure valve 260 is in place and the upstream pressure exceeds the downstream pressure by a preselected amount, differential pressure valve 260 operates from the closed position depicted in FIGS. 19A and 19B to the open position depicted in FIGS. 20A and 20B. Specifically, the upstream pressure enters differential pressure valve 260 through openings 274. The downstream pressure enters differential pressure valve 260 through fluid passageway 284. It should be noted, however, by those skilled in the art that it may be desirable to obtain the downstream pressure from a point that if further downstream of differential pressure valve 260. In this case, additional tubing may be coupled to fluid passageway 284 to extend this distance. In either case, the differential pressure between the upstream pressure and downstream pressure acts on O-rings 318 and O-ring 320. When the upstream pressure exceeds the downstream pressure by the amount necessary to compress piston spring 306, piston 302 moves downwardly relative to sleeve 294.

This downward movement shifts the upper extension of piston 302 downwardly relative to lug 312 which slides radially inwardly such that lug 312 no longer rests on shoulder 314 of main housing section 266. When shoulder 314 no longer supports the downward bias force of main spring 298, this bias force downwardly shifts piston 302 together with sleeve 294 operating differential pressure valve 260 into the position depicted in FIGS. 20A and 20B. In this configuration, openings 296 of sleeve 294 are no longer sealed by O-ring 324 but instead are aligned with windows 288 of upper connector extension 286. In addition, O-ring 316 now provides a seal between piston 302 and main housing section 266. Accordingly, fluid communication is allowed from the exterior of differential pressure valve 260 to the longitudinal bore of sleeve 294 through openings 274 in main housing section 266 and openings 296 in sleeve 294. It should be noted that during the operation of differential pressure valve 260 from the closed position to the open position, a bypass section 326 near the lower end of sleeve 294 temporarily allows fluid to pass between sleeve 294 and the upper end of lower connector extension 270 around O-ring 328. This temporary leak reduces the force necessary to shift differential pressure valve 260 from the closed position to the open position by allowing pressure equalization between the longitudinal bore of sleeve 294 and the annular area between sleeve 294 and main housing section 266.

Once the gravel packing operation is complete, it may be desirable to perform additional well operations prior to removing differential pressure valve 260 from within the sand control screen assemblies. Specifically, it may desirable to perform an acid treatment prior to such removal. Using differential pressure valve 260 of the present invention, the acid treatment may be pumped down the interior of the wash pipe assembly including differential pressure valve 260 without losing fluids from the interior to the exterior of differential pressure valve 260. Specifically, bladder 292 provides a seal against openings 274 such that fluid will travel to the end of the wash pipe assembly.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for gravel packing a production interval of a wellbore using an alpha-beta gravel packing technique, the apparatus comprising:

a packer assembly;

first and second sand control screen assemblies connected relative to the packer assembly;

a cross-over assembly providing a lateral communication path downhole of the packer assembly for a gravel packing fluid and a lateral communication path uphole of the packer assembly for a return fluid;

a wash pipe assembly in communication with the lateral communication path uphole of the packer assembly and extending into the first and second sand control screen assemblies such that an annulus is formed therebetween; and a valve positioned within the wash pipe assembly in a location between the first and second sand control screen assemblies, the valve actuatable from a closed position to an open position when a beta wave is proximate the location of the valve.

2. The apparatus as recited in claim 1 wherein the valve is actuated in response to the pressure in the annulus upstream of the valve exceeding the pressure in the annulus downstream of the valve by a predetermined magnitude.

3. The apparatus as recited in claim 2 further comprising a restrictor member disposed between the first and second sand control screen assemblies, the restrictor member having a radially reduced section that reduces the flow area in the annulus adjacent to the restrictor member, thereby increasing the pressure drop in the return fluid traveling therethrough.

4. The apparatus as recited in claim 3 wherein the restrictor member is positioned in the location adjacent to the valve.

5. The apparatus as recited in claim 3 wherein the radially reduced section of the restrictor member has a turbulizirig profile that increases the pressure drop in the return fluid traveling therethrough.

6. The apparatus as recited in claim 2 further comprising a turbulizer member disposed between the first and second sand control screen assemblies, the turbulizer member increasing the pressure drop in the return fluid traveling therethrough.

7. The apparatus as recited in claim 6 wherein the turbulizer member is positioned in the location adjacent to the valve.

8. The apparatus as recited in claim 2 further comprising a restrictor member disposed within the wash pipe assembly, the restrictor member having a radially increased section that reduces the flow area in the annulus adjacent to the restrictor member, thereby increasing the pressure drop in the return fluid traveling therethrough.

9. The apparatus as recited in claim 8 wherein the restrictor member is integral with the valve.

10. The apparatus as recited in claim 8 wherein the radially increased section of the restrictor member has a turbulizing profile that increases the pressure drop in the return fluid traveling therethrough.

11. The apparatus as recited in claim 2 further comprising a turbulizer member disposed within the wash pipe assembly, the turbulizer member increasing the pressure drop in the return fluid traveling therethrough.

12. The apparatus as recited in claim 11 wherein the turbulizer member is integral with the valve.

13. The apparatus as recited in claim 2 further comprising a first restrictor member disposed between the first and second sand control screen assemblies and a second restrictor member disposed within the wash pipe assembly adjacent to the first restrictor member, the first restrictor member having a radially reduced section, the second restrictor member having a radially increased section such that the flow area in the annulus between the first and second restrictor members is reduced, thereby increasing the pressure drop in the return fluid traveling therethrough.

14. The apparatus as recited in claim 13 wherein the radially reduced section of the first restrictor member and the radially increased section of the second restrictor member have turbulizing profiles that increases the pressure drop in the return fluid traveling therethrough.

15. The apparatus as recited in claim 13 wherein the second restrictor member is integral with the valve.

16. The apparatus as recited in claim 2 further comprising a first turbulizer member disposed between the first and second sand control screen assemblies and a second turbulizer member disposed within the wash pipe assembly adjacent to the first turbulizer member, the first and second turbulizer members increasing the pressure drop in the return fluid traveling therethrough.

17. The apparatus as recited in claim 1 wherein the valve is actuated in response to an increase an the flow velocity in the annulus caused by the beta wave.

18. The apparatus as recited in claim 1 wherein the valve is actuated in response to an increase in the density in the wellbore caused by the beta wave.

19. An apparatus for gravel packing a production interval of a wellbore using an alpha-beta gravel packing technique, the apparatus comprising:

a packer assembly;

a work string traversing the packer assembly, the work string including first and second sand control screen assemblies, a first restrictor member having a radially reduced section positioned therebetween and a crossover assembly providing a lateral communication path downhole of the packer assembly for a gravel packing fluid and a lateral communication path uphole of the packer assembly for a return fluid; and a wash pipe assembly in communication with the lateral communication path uphole of the packer assembly and extending into the first and second sand control screen assemblies such that an annulus is formed therebetween, the wash pipe assembly including a valve positioned adjacent to the first restrictor member, the valve actuatable from a closed position to an open position when a beta wave is proximate a location adjacent to the valve and the pressure in the annulus upstream of the valve exceeds the pressure in the annulus downstream of the valve by a predetermined magnitude.

20. The apparatus as recited in claim 19 wherein the radially reduced section of the restrictor member has a turbulizing profile that increases the pressure drop in the return fluid traveling therethrough.

21. The apparatus as recited in claim 19 further comprising a second restrictor member disposed within the wash pipe assembly, the second restrictor member having a radially increased section that reduces the flow area in the annulus adjacent to the second restrictor member, thereby increasing the pressure drop in the return fluid traveling therethrough.

22. The apparatus as recited in claim 21 wherein the second restrictor member is integral with the valve.

23. The apparatus as recited in claim 21 wherein the radially increased section of the second reatrictor member has a turbulizing profile that increases the pressure drop in the return fluid traveling therethrough.

24. An upstream-downstream differential pressure valve for gravel packing an interval of a wellbore using an alpha-beta gravel packing technique, the valve positioned within a wash pipe assembly that is disposed within a work string having first and second sand control screen assemblies such that an annulus is formed therebetween, the valve positioned at a location between the first and second sand control screen assemblies, the valve comprising:

an outer housing; and a sliding sleeve that is operated from a closed position to an open position when a beta wave is proximate the hole location and the pressure in the annulus upstream of the valve exceeds the pressure in the annulus downstream of the valve by a predetermined magnitude.

25. The valve as recited in claim 24 wherein the outer housing includes an upstream pressure port and a downstream pressure port, the upstream pressure port in fluid communication with the annulus upstream of the valve, the downstream pressure port in fluid communication with the annulus downstream of the valve.

26. The valve as recited in claim 25 further comprising a spring disposed between the outer housing and the sliding sleeve, the pressure from the downstream pressure port and the spring biasing the sliding sleeve toward the closed position such that the pressure from the upstream pressure port must exceed the pressure from the downstream pressure port by a magnitude sufficient to overcome the spring force to operate the sliding sleeve to the open position.

27. The valve as recited in claim 24 further comprising a piston disposed within a sidewall bore of the outer housing that is in communication with the downstream pressure port on one side and the upstream pressure port on the other side such that when the pressure from the upstream port exceeds the pressure from the downstream pressure port by a magnitude sufficient to slide the piston from a first position to a second position, the pressure from the upstream pressure port is communicated to the sliding sleeve such that the sliding sleeve is operated from the closed position to the open position.

28. A method for gravel packing a production interval of a wellbore, the method comprising the steps of:

positioning first and second sand control screen assemblies within the production interval;

disposing a wash pipe assembly within the first and second sand control screen assemblies such that an annulus is formed therebetween, the wash pipe assembly including a valve positioned in a location between the first and second sand control screen assemblies;

injecting a fluid slurry containing gravel into the production interval exteriorly of the first and second sand control screen assemblies;

depositing gravel on a low side of the production interval by propagating an alpha wave from the near end to the far end of the production interval;

depositing gravel on a high side of the production interval on top of the gravel on the low side of the production interval by propagating a beta wave from the far end to the near end of the production interval; and actuating the valve from a closed position to an open position when the beta wave is proximate the location of the valve.

29. The method as recited in claim 28 further comprising the step of actuating the valve in response to the pressure in the annulus upstream of the valve exceeding the pressure in the annulus downstream of the valve by a predetermined magnitude.

30. The method as recited in claim 29 further comprising the step of intensifying the differential pressure upstream and downstream of the valve by reducing the flow area in the annulus with a restrictor member disposed between the first and second sand control screen assemblies.

31. The method as recited in claim 30 further comprising the step of further intensifying the differential pressure upstream and downstream of the valve with a turbulizing profile on the restrictor member.

32. The method as recited in claim 29 further comprising the step of further intensifying the differential pressure upstream and downstream of the valve with a turbulizer member disposed between the first and second sand control screen assemblies.

33. The method as recited in claim 29 further comprising the step of intensifying the differential pressure upstream and downstream of the valve by reducing the flow area in the annulus with a restrictor member disposed within the wash pipe assembly.

34. The method as recited in claim 33 further comprising the step of further intensifying the differential pressure upstream and downstream of the valve with a turbulizing profile on the restrictor member.

35. The method as recited in claim 29 further comprising the step of further intensifying the differential pressure upstream and downstream of the valve with a turbulizer member disposed in the wash pipe assembly.

36. The method as recited in claim 29 further comprising the step of intensifying the differential pressure upstream and downstream of the valve by reducing the flow area in the annulus with a first restrictor member disposed between the first and second sand control screen assemblies and a second restrictor member disposed within the wash pipe assembly.

37. The method as recited in claim 36 further comprising the step of further intensifying the differential pressure upstream and downstream of the valve with a turbulizing profile on the first restrictor member and the second restrictor member.

38. The method as recited in claim 28 further comprising the step of actuating the valve in response to an increase in the flow velocity in the annulus caused by the beta wave.

39. The method as recited in claim 28 further comprising the step of actuating the valve in response to an increase in the density in the wellbore caused by the beta wave.

40. A method for gravel packing a production interval of a wellbore, the method comprising the steps of:

positioning first and second sand control screen assemblies within the production interval;

disposing a wash pipe assembly within the first and second sand control screen assemblies such that an annulus is formed therebetween, the wash pipe assembly including a valve positioned in a location between the first and second sand control screen assemblies;

gravel packing the production interval by propagating an alpha wave from the near end to the far end of the production interval and propagating a beta wave from the far end to the near end of the production interval;

actuating the valve from a closed position to an open position when the beta wave is proximate the location of the valve and the pressure in the annulus upstream of the valve exceeds the pressure in the annulus downstream of the valve by a predetermined magnitude; and intensifying the differential pressure upstream and downstream of the valve by reducing the flow area in the annulus with a first restrictor member disposed between the first and second sand control screen assemblies.

41. The method as recited in claim 40 further comprising the step of further intensifying the differential pressure upstream and downstream of the valve with a turbulizing profile on a radially reduced section of the first restrictor member.

42. The method as recited in claim 40 further comprising the step of further intensifying the differential pressure upstream and downstream of the valve by reducing the flow area in the annulus with a second restrictor member disposed within the wash pipe assembly.

43. The method as recited in claim 42 wherein the step of further intensifying the differential pressure upstream and downstream of the valve further comprises the step of adding a turbulizing profile on the second restrictor member.

44. A differential pressure valve comprising:

a housing having an opening;

a sleeve having an opening, the sleeve slidably disposed within the housing forming an annulus therebetween, the sleeve having first and second sleeve positions relative to the housing, in the first sleeve position, the opening of the sleeve is in fluid isolation from the opening of the housing, in the second sleeve position, the opening of the sleeve is in fluid communication with the opening of the housing;

first and second biasing members disposed within the annulus; and a piston disposed within the annulus and between the first and second biasing members, the piston having first and second piston positions relative to the sleeve, in the first piston position, the piston is biased in a first direction relative to the sleeve by a first pressure and in a second direction relative to the sleeve by the second biasing member and a second pressure, the piston operating from the first piston position to the second piston position when the bias force in the first direction exceeds the bias force in the second direction such that the first biasing member operates the sleeve from the first sleeve position to the second sleeve position.

45. A differential pressure valve comprising:

a housing having an opening;

a sleeve having an opening, the sleeve slidably disposed within the housing forming an annulus therebetween, the sleeve having a first sleeve position relative to the housing wherein the opening of the sleeve is in fluid isolation from the opening of the housing, the sleeve having a second sleeve position relative to the housing wherein the opening of the sleeve is in fluid communication with the opening of the housing; and a piston disposed within the annulus, the piston having first and second piston positions relative to the sleeve, the piston operating from the first piston position to the second piston position when the differential pressure across the piston exceeds a predetermined amount, the sleeve operating from the first sleeve position to the second sleeve position when the piston operates to the second piston position.

* * * * *